US006198805B1

(12) United States Patent
Jambunathan et al.

(10) Patent No.: US 6,198,805 B1
(45) Date of Patent: Mar. 6, 2001

(54) X-RAY-TUBE TARGET ASSEMBLY AND METHOD FOR MAKING

(75) Inventors: Viswanathan Jambunathan, Latham, NY (US); Vivek Bhatt, Wauwatosa, WI (US); Mark Ernest Vermilyea, Niskayuna; Bijan Dorri, Clifton Park, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/377,295

(22) Filed: Aug. 19, 1999

(51) Int. Cl.[7] ..... H01J 35/10

(52) U.S. Cl. ..... 378/144; 378/143

(58) Field of Search ..... 378/143, 144, 378/121, 127, 131, 141

(56) References Cited

U.S. PATENT DOCUMENTS

| | | | | |
|---|---|---|---|---|
| 5,498,187 | * | 3/1996 | Eggleston et al. | 378/144 |
| 5,592,525 | | 1/1997 | Reznikov et al. | 378/121 |
| 5,875,227 | | 2/1999 | Bhatt | 378/132 |

FOREIGN PATENT DOCUMENTS

| | | | | |
|---|---|---|---|---|
| 4127414 A1 | * | 3/1992 | (DE) | 378/144 |
| 0055828 | * | 7/1982 | (EP) | 378/144 |
| 406076722 | * | 3/1994 | (JP) | 378/144 |

* cited by examiner

*Primary Examiner*—David P. Porta
*Assistant Examiner*—Irakli Kiknadze

(57) ABSTRACT

An X-ray-tube target assembly includes an annular monolithic X-ray-tube target shaft and a monolithic X-ray-tube target cap. The target shaft is a stepped target shaft. The target cap is inertially welded to the target shaft. The target assembly is made by inertially welding together a monolithic solid cylinder and a monolithic solid X-ray-tube target cap and then machining the target shaft to be annular and to have the step.

15 Claims, 3 Drawing Sheets

X-RAY-TUBE TARGET ASSEMBLY AND METHOD FOR MAKING

BACKGROUND OF THE INVENTION

The present invention relates generally to X-ray tubes, and more particularly to a target assembly for an X-ray tube and to a method for making the target assembly.

X-ray equipment used in the medical field typically includes a rotating anode X-ray tube. Such X-ray tubes are vacuum tubes whose anodes each include a rotor having a rotatable rotor shaft and also include a stator which circumferentially surrounds, or is circumferentially surrounded by, the rotatable rotor shaft. A pair of bearings, such as rolling element bearings (e.g., ball bearings), is positioned radially between the rotor shaft and the stator.

The anode also has an X-ray target which includes a target cap attached to an annular target shaft. The target cap has a target track portion which produces X-rays and heat when struck by electrons emitted by the X-ray tube's cathode. The target cap may also have a central bore used to evacuate the anode when creating the vacuum during tube construction. The target typically also includes a graphite heat sink attached to the target cap. The target shaft is bolted to the rotor shaft either directly or through intermediate members. The bearings get heated to high temperatures since some of the heat produced by the target track region of the target cap flows by solid conduction from the target cap to the target shaft and then from the target shaft to the bearings. The bearings are poor thermal conductors which sets up a temperature differential between the rotating side and the stationary side of the bearings causing bearing misalignment and wear which shortens the operating life of the X-ray tube. Additional heat also comes from backscattered electrons entering the bore of the target cap and impinging on anode structure near the front bearing.

Known designs include X-ray-tube targets which have been constructed by bolting, or threading and brazing, together two target shaft members. Such bolted, or threaded and brazed, joints are under cyclic thermal and mechanical loads and have become loose over time causing tube vibrations requiring immediate system shutdown and tube replacement.

What is needed is an improved X-ray-tube target which reduces heat flow to the bearings without having a tendency to cause tube vibrations requiring unscheduled system shutdown for tube replacement.

BRIEF SUMMARY OF THE INVENTION

In one expression of the invention, an X-ray-tube target assembly includes an annular monolithic X-ray-tube target shaft and a monolithic X-ray-tube target cap. The target shaft has a generally longitudinal axis, has longitudinally-outermost first and second ends, and has longitudinally-extending first and second portions. The first portion extends longitudinally from proximate the first end toward the second portion, and the second portion extends longitudinally from proximate the second end toward the first portion. The first and second portions have inner and outer radii. The inner radius of the first portion is smaller than the inner radius of the second portion, and the outer radius of the first portion is smaller than the outer radius of the second portion. The target cap has a generally disk shape, is generally coaxially aligned with the longitudinal axis, and is inertially welded to the shaft proximate the first end.

In a second expression of the invention, a method for making an X-ray-tube target assembly includes steps a) through e). Step a) obtains a monolithic solid cylinder having a generally longitudinal axis and having a first radius, and step b) obtains a monolithic X-ray-tube target cap having a shape of a solid disk and having a second radius which is larger than the first radius. Step c) coaxially aligns the cylinder and the target cap, and step d), which is performed after step c), inertially welds together the cylinder and the target cap. Step e), which is performed after step d), machines the cylinder as required to define a hollow X-ray-tube target shaft having longitudinally-outermost first and second ends and having longitudinally-extending first and second portions, wherein the first portion extends longitudinally from proximate the first end toward the second portion, wherein the second portion extends longitudinally from proximate the second end toward the first portion, wherein the first and second portions have inner and outer radii, wherein the inner radius of the first portion is smaller than the inner radius of the second portion, and wherein the outer radius of the first portion is smaller than the outer radius of the second portion. In one variation of the method, another step is added. The added step, which is performed after step d), machines a through hole in the target cap such that the through hole is generally coaxially aligned with the longitudinal axis and such that the radius of the through hole is no larger than the inner radius of the first portion.

Several benefits and advantages are derived from the invention. The target shaft and cap assembly has no bolted, threaded and brazed, or other joints which eliminates the possibility of joint loosening causing tube vibrations requiring immediate system shutdown and tube replacement. Eliminating this cause of early tube failure will extend the life of the X-ray tube. The step target shaft design increases the length of the solid conduction thermal path reducing the heat flow to the bearings. When present, the through hole in the cap, having a small radius, allows anode evacuation when creating the vacuum during tube construction and, at the same time, reduces the number of backscattered electrons hence reducing the heat load on the bearings. Such heat flow and heat load reduction allows the X-ray tube to be run at higher energies while meeting temperature limits on the bearings.

DETAILED DESCRIPTION OF THE INVENTION

Figure 1:
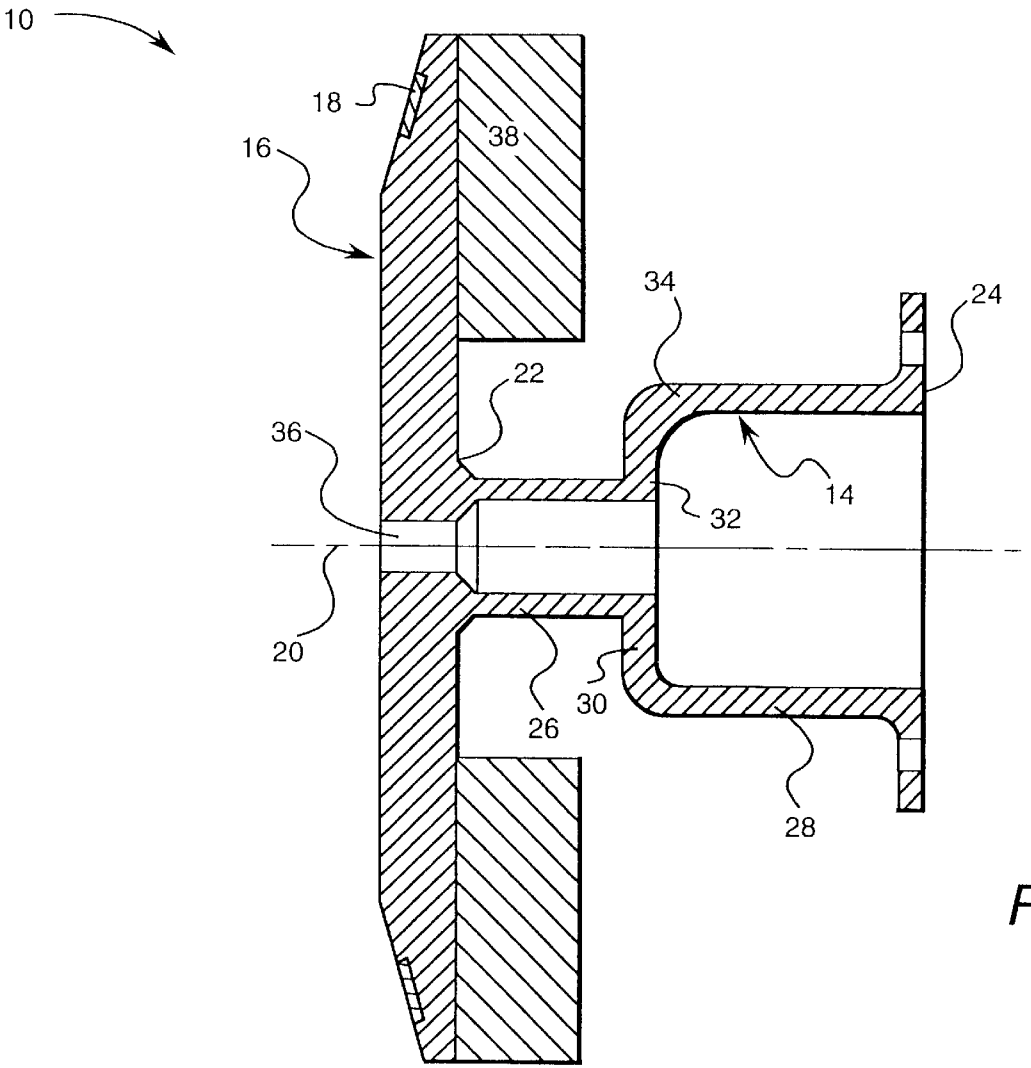
FIG. 1 is a schematic cross-sectional view of a first embodiment of an X-ray-tube target assembly of the present invention.
Figure 2:
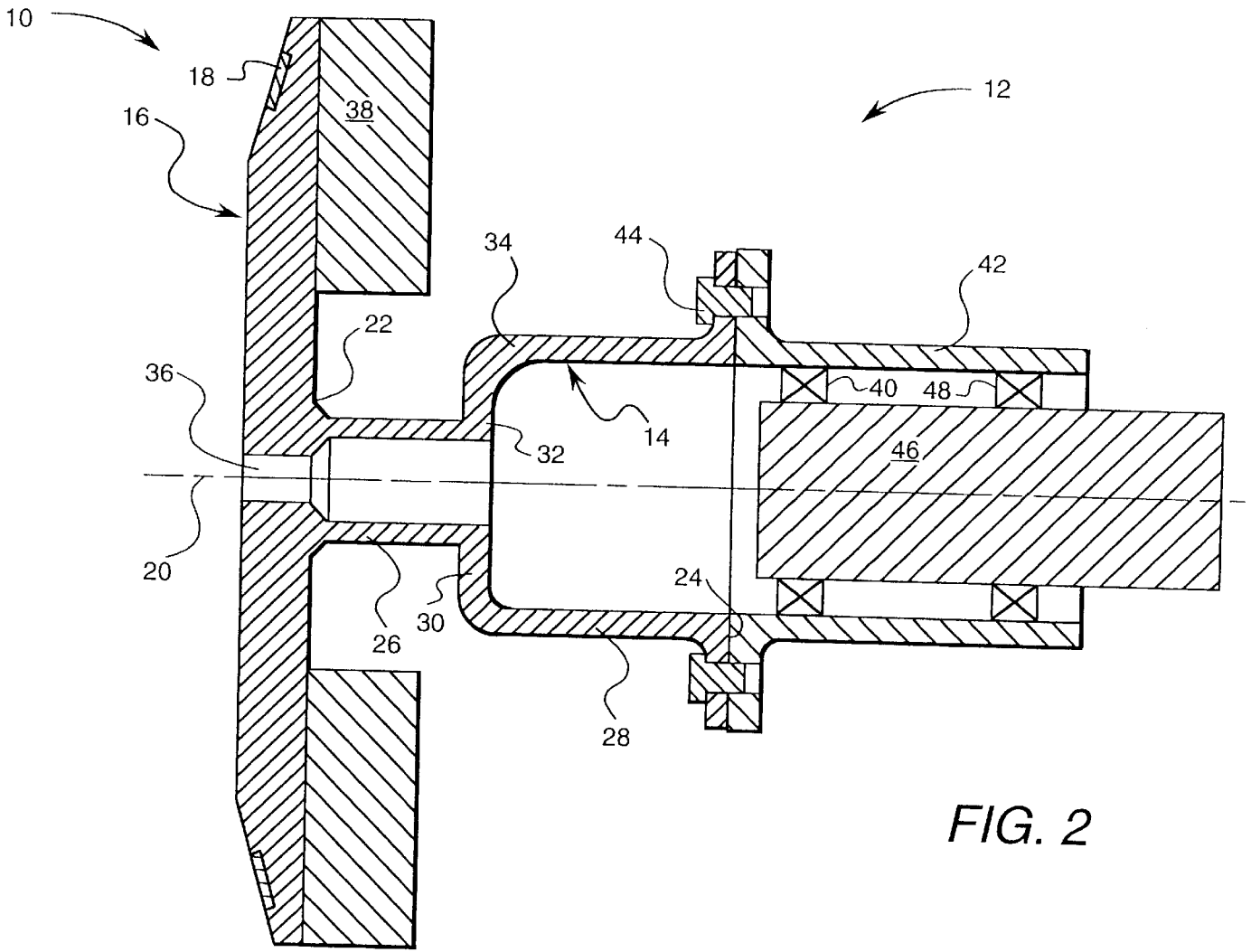
FIG. 2 is a schematic cross-sectional view of a first embodiment of a portion of an X-ray tube assembly of the present invention including the X-ray-tube target assembly of FIG. 1.

Referring now to the drawings, wherein like numerals represent like elements throughout, FIG. 1 schematically shows a first embodiment of an X-ray-tube target assembly 10 of the present invention, and FIG. 2 schematically shows a first embodiment of a portion of an X-ray tube assembly 12 of the present invention including the X-ray-tube target assembly 10 of FIG. 1. As shown in FIG. 1, the X-ray-tube target assembly 10 includes an annular monolithic X-ray-tube target shaft 14 and a monolithic X-ray-tube target cap 16. By "monolithic" is meant that the target shaft 14 is metallurgically created as a single piece and not two or more pieces which are later joined together, and the target cap 16 is metallurgically created as a single piece and not two or more pieces which are later joined together. Typically, the target shaft 14 consists essentially of a molybdenum alloy (such as TZM, alloy 2, or MHC) and is created using standard powder metallurgy techniques. Typically, the target cap 16 consists essentially of a molybdenum alloy (such as TZM, alloy 2, or MHC) except for a target track portion 18 consisting essentially of tungsten (or other high Z material), and the target cap 16 is created using standard powder metallurgy techniques.

The target shaft 14 has a generally longitudinal axis 20, has longitudinally-outermost first and second ends 22 and 24, and has longitudinally-extending first and second portions 26 and 28. The first portion 26 extends longitudinally from proximate the first end 22 toward the second portion 28, and the second portion 28 extends longitudinally from proximate the second end 24 toward the first portion 26. By "proximate" is meant at or within a longitudinal distance of fifteen percent of the longitudinal length of the target shaft 14. The first and second portions 26 and 28 have inner and outer radii. The inner radius of the first portion 26 is smaller than the inner radius of the second portion 28, and the outer radius of the first portion 26 is smaller than the outer radius of the second portion 28. Thus, the target shaft 14 may be described as a step target shaft. The target shaft 14 may have more than one step, as can be appreciated by the artisan.

In one construction, the inner and outer radii of the first and second portions 26 and 28 are generally constant. By "generally constant" is meant that there is a ten percent or less variation in a radius along the longitudinal length of a portion. The inner radius of the first portion 26 is no larger than half the inner radius of the second portion 28, and the outer radius of the first portion 26 is no larger than half the outer radius of the second portion 28.

In one design, the target shaft 14 has a generally radially extending shoulder portion 30. The shoulder portion 30 has a radially-innermost region 32 extending to the first portion 26. The shoulder portion 30 also has a radially-outermost region 34 extending to the second portion 28.

The target cap 16 has a generally disk shape. The target cap 16 is generally coaxially aligned with the longitudinal axis 20. The target cap 16 is inertially welded to the target shaft 14 proximate the first end 22.

In one construction, the inertial weld is made at the first end 22. It is noted that the radial thickness of the target shaft 16 at the inertial weld is larger than the radial thickness of the first portion 26 to conservatively assure proper structural strength of the target assembly 10, as is known to the artisan.

In one design, the target cap 16 has a through hole 36 generally coaxially aligned with the longitudinal axis 20. The through hole 36 has a radius. The radius of the through hole 36 is no larger than the inner radius of the first portion 26.

In another design, the target assembly 10 includes a heat sink 38 which is attached to the target cap 16. Typically, the heat sink 38 consists essentially of graphite. Typically, the heat sink 38 is brazed to the target cap 16.

As shown in FIG. 2, the X-ray tube assembly 12 includes an annular monolithic X-ray-tube target shaft 14, a monolithic X-ray-tube target cap 16, and a bearing 40.

The target shaft 14 has a generally longitudinal axis 20, has longitudinally-outermost first and second ends 22 and 24, and has longitudinally-extending first and second portions 26 and 28. The first portion 26 extends longitudinally from proximate the first end 22 toward the second portion 28, and the second portion 28 extends longitudinally from proximate the second end 24 toward the first portion 26. The first and second portions 26 and 28 have inner and outer radii. The inner radius of the first portion 26 is smaller than the inner radius of the second portion 28, and the outer radius of the first portion 26 is smaller than the outer radius of the second portion 28.

In one construction, the inner and outer radii of the first and second portions 26 and 28 are generally constant. The inner radius of the first portion 26 is no larger than half the inner radius of the second portion 28, and the outer radius of the first portion 26 is no larger than half the outer radius of the second portion 28.

In one design, the target shaft 14 has a generally radially extending shoulder portion 30. The shoulder portion 30 has a radially-innermost region 32 extending to the first portion 26. The shoulder portion 30 also has a radially-outermost region 34 extending to the second portion 28.

In another design, the target shaft 14 has an axis of rotation which is coincident with the longitudinal axis 20.

The target cap 16 has a generally disk shape. The target cap 16 is generally coaxially aligned with the longitudinal axis 20. The target cap 16 is inertially welded to the target shaft 14 proximate the first end 22. The target cap 16 includes a target track portion 18 which produces X-rays and heat when struck by electrons.

In one design, the target cap 16 has a through hole 36 generally coaxially aligned with the longitudinal axis 20. The through hole 36 has a radius. The radius of the through hole 36 is no larger than the inner radius of the first portion 26.

The bearing 40 rotatably supports the second portion 28. At least a portion of the heat produced by the target track portion 18 of the target cap 16 flows by solid conduction from the target cap 16 to the first portion 26, then from the first portion 26 to the second portion 28, and then from the second portion 28 to the bearing 40.

In one design, the tube assembly 12 also has an motor rotor 42 secured by bolts 44 to the second end 24 of the target shaft 14 of the target assembly 10. Here, the tube assembly 12 further has an bearing shaft 46 and an additional bearing 48, wherein the motor rotor 42 is rotatably attached to the bearing shaft 46 by bearing 40 and additional bearing 48. Other components of an X-ray-tube anode assembly and an X-ray tube, such as a thermal barrier disposed between and connecting together the second portion 28 and the motor rotor 42, do not form part of the present invention and are not discussed in the specification or shown in the drawings, such components being well known to the artisan.

It is noted that the target shaft 14 and cap 16 assembly has no bolted, threaded and brazed, or other joints which eliminates the possibility of joint loosening causing tube vibrations requiring immediate tube shutdown and tube replacement. Eliminating this cause of early tube failure will extend the life of the X-ray tube. The step target shaft design increases the length of the solid conduction thermal path reducing the heat flow to the bearings 40 and 48. The through hole 36 in the target cap 16, having a small radius, allows anode evacuation when creating the vacuum during tube construction and, at the same time, reduces the number of backscattered electrons which add to the heat load on the bearings 40 and 48. Such heat flow and heat load reduction allows the X-ray tube to be run at higher energies while meeting thermal constraints on the bearings. The larger radii of the second portion 28 proximate the second end 24 of the target shaft 14 provides good alignment of the target-shaft axis 20 with the bearing axis (i.e., the axis of rotation, not labeled). This suppresses the increase in focal spot motion as the tube ages. As can be appreciated by the artisan, the radii of the first and second portions 26 and 28 may be optimally chosen for ease of manufacture as well as for thermal and mechanical benefits, the radius of the through hole 36 in the target cap 16 may be kept at a minimum needed for proper evacuation during tube processing and seasoning, and the thickness of the first and second portions 26 and 28 may be optimally chosen to avoid undesirable target vibrations.

Figure 3:
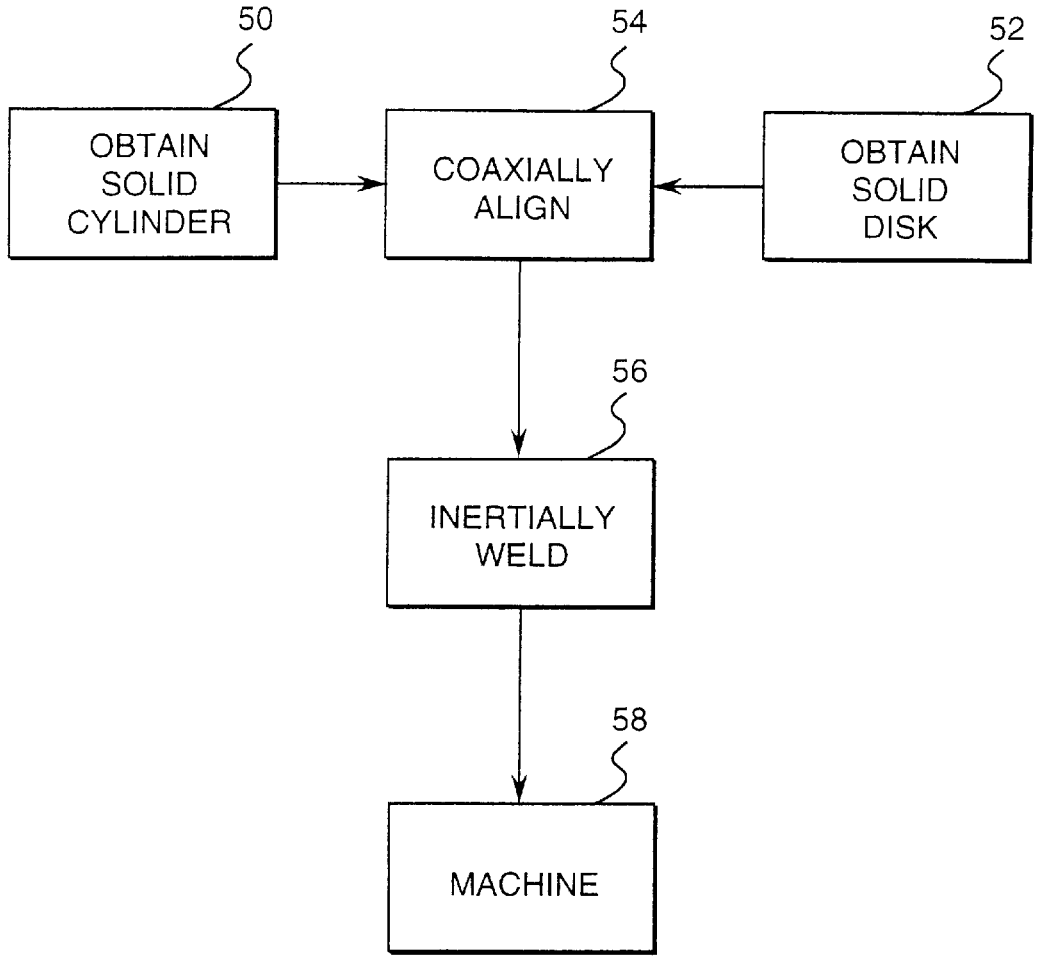
FIG. 3 is a block diagram of a first method of the present invention for making an X-ray-tube target assembly (an embodiment of which is shown in FIG. 1).

Referring again to the drawings, FIG. 3 shows a block diagram of a first method of the present invention having several steps for making an X-ray-tube target assembly. Step a) is labeled in block 50 of FIG. 3 as "Obtain Solid Cylinder" and includes the step of obtaining a solid cylinder having a generally longitudinal axis and having a first radius. In one construction, the solid cylinder is a commercially-obtainable molybdenum solid cylinder created by powder metallurgy techniques. Step b) is labeled in block 52 of FIG. 3 as "Obtain Solid Disk" and includes the step of obtaining an X-ray-tube target cap having a shape of a solid disk and having a second radius which is larger than the first radius of the solid cylinder obtained in step a). In one construction, the target cap is a commercially-obtainable (TZM, alloy 2, or MHC) molybdenum target cap, having a tungsten (or other high Z material) target track region, created by powder metallurgy techniques. Step c) is labeled in block 54 of FIG. 3 as "Coaxially Align" and includes the step of coaxially aligning the cylinder and the target cap. Step d) is labeled in block 56 of FIG. 3 as "Inertially Weld" and includes the step, after step c), of inertially welding together the cylinder and the target cap.

Step e) is labeled in block 58 of FIG. 3 as "Machine" and includes the step, after step d), of machining the cylinder as required to define a hollow X-ray-tube target shaft (a first embodiment 14 of which is shown in FIG. 1) having longitudinally-outermost first and second ends (a first embodiment 22 and 24 of which is shown in FIG. 1) and having longitudinally-extending first and second portions (a first embodiment 26 and 28 of which is shown in FIG. 1), wherein the first portion extends longitudinally from proximate the first end toward the second portion, wherein the second portion extends longitudinally from proximate the second end toward the first portion, wherein the first and second portions have inner and outer radii, wherein the inner radius of the first portion is smaller than the inner radius of the second portion, and wherein the outer radius of the first portion is smaller than the outer radius of the second portion. By "machining" is meant any type of material removing operation including, without limitation, mechanical, chemical, electrical, and/or laser machining. By "as required" is meant that machining is not required for a portion of the cylinder to establish a particular outer radius wherein the cylinder is obtained with that portion already having that particular outer radius.

In one implementation of the first method, step e) includes machining the cylinder such that the inner and outer radii of the first and second portions (a first embodiment 26 and 28 of which is shown in FIG. 1) are generally constant, such that the inner radius of the first portion is no larger than half the inner radius of the second portion, and such that the outer radius of the first portion is no larger than half the outer radius of the second portion. In another implementation of the first method, step e) includes machining the cylinder such that the target shaft (a first embodiment 14 of which is shown in FIG. 1) also has a generally radially extending shoulder portion (a first embodiment 30 of which is shown in FIG. 1), wherein the shoulder portion has a radially-innermost region extending to the first portion and has a radially-outermost region extending to the second portion. In an extension of the first method there is added step f), wherein step e) and step f) are labeled together in block 58 of FIG. 3 as "Machine" and wherein step f) includes the step, after step d), of machining a through hole (a first embodiment 36 of which is shown in FIG. 1) in the target cap (a first embodiment 16 of which is shown in FIG. 1) such that the through hole is generally coaxially aligned with the longitudinal axis and such that the radius of the through hole is no larger than the inner radius of the first portion.

The foregoing description of several embodiments and methods of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. An X-ray-tube target assembly comprising:

a) an annular monolithic X-ray-tube target shaft having a generally longitudinal axis, having longitudinally-outermost first and second ends, and having longitudinally-extending first and second portions, wherein said first portion extends longitudinally from proximate said first end toward said second portion, wherein said second portion extends longitudinally from proximate said second end toward said first portion, wherein said first and second portions have inner and outer radii, wherein said inner radius of said first portion is smaller than said inner radius of said second portion, and wherein said outer radius of said first portion is smaller than said outer radius of said second portion; and b) a monolithic X-ray-tube target cap, wherein said target cap has a generally disk shape, is generally coaxially aligned with said longitudinal axis, and is inertially welded to said target shaft proximate said first end.

2. The assembly of claim 1, wherein said inner and outer radii of said first and second portions are generally constant, wherein said inner radius of said first portion is no larger than half said inner radius of said second portion, and wherein said outer radius of said first portion is no larger than half said outer radius of said second portion.

3. The assembly of claim 2, wherein said target cap has a through hole generally coaxially aligned with said longitudinal axis, wherein said through hole has a radius, and wherein said radius of said through hole is no larger than said inner radius of said first portion.

4. The assembly of claim 3, wherein said target shaft has a generally radially extending shoulder portion, wherein said shoulder portion has a radially-innermost region extending to said first portion and has a radially-outermost region extending to said second portion.

5. An X-ray tube assembly comprising:

a) an annular monolithic X-ray-tube target shaft having a generally longitudinal axis, having longitudinally-outermost first and second ends, and having longitudinally-extending first and second portions, wherein said first portion extends longitudinally from proximate said first end toward said second portion, wherein said second portion extends longitudinally from proximate said second end toward said first portion, wherein said first and second portions have inner and outer radii, wherein said inner radius of said first portion is smaller than said inner radius of said second portion, and wherein said outer radius of said first portion is smaller than said outer radius of said second portion;

b) a monolithic X-ray-tube target cap, wherein said target cap has a generally disk shape, is generally coaxially aligned with said longitudinal axis, is inertially welded to said target shaft proximate said first end, and includes a target track portion which produces X-rays and heat when struck by electrons; and c) a bearing rotatably supporting said second portion, wherein at least a portion of said heat produced by said target track portion of said target cap flows by solid conduction from said target cap to said first portion, then from said first portion to said second portion, and then from said second portion to said bearing.

6. The assembly of claim 5, wherein said target shaft has an axis of rotation which is coincident with said longitudinal axis.

7. The assembly of claim 6, wherein said target shaft has a generally radially extending shoulder portion, wherein said shoulder portion has a radially-innermost region extending to said first portion and has a radially-outermost region extending to said second portion.

8. The assembly of claim 7, wherein said target cap has a through hole generally coaxially aligned with said longitudinal axis, wherein said through hole has a radius, and wherein said radius of said through hole is no larger than said inner radius of said first portion.

9. The assembly of claim 8, wherein said inner and outer radii of said first and second portions are generally constant, wherein said inner radius of said first portion is no larger than half said inner radius of said second portion, and wherein said outer radius of said first portion is no larger than half said outer radius of said second portion.

10. A method for making an X-ray-tube target assembly, said method comprising the steps of:

a) obtaining a monolithic solid cylinder having a generally longitudinal axis and having a first radius;

b) obtaining a monolithic X-ray-tube target cap having a shape of a solid disk and having a second radius which is larger than said first radius;

c) coaxially aligning said cylinder and said target cap;

d) after step c), inertially welding together said cylinder and said target cap; and e) after step d), machining said cylinder as required to define a hollow X-ray-tube target shaft having longitudinally-outermost first and second ends and having longitudinally-extending first and second portions, wherein said first portion extends longitudinally from proximate said first end toward said second portion, wherein said second portion extends longitudinally from proximate said second end toward said first portion, wherein said first and second portions have inner and outer radii, wherein said inner radius of said first portion is smaller than said inner radius of said second portion, and wherein said outer radius of said first portion is smaller than said outer radius of said second portion.

11. The method of claim 10, wherein step e) includes machining said cylinder such that said inner and outer radii of said first and second portions are generally constant, such that said inner radius of said first portion is no larger than half said inner radius of said second portion, and such that said outer radius of said first portion is no larger than half said outer radius of said second portion.

12. The method of claim 11, wherein step e) includes machining said cylinder such that said target shaft also has a generally radially extending shoulder portion, wherein said shoulder portion has a radially-innermost region extending to said first portion and has a radially-outermost region extending to said second portion.

13. A method for making an X-ray-tube target assembly comprising the steps of:

a) obtaining a monolithic solid cylinder having a generally longitudinal axis and having a first radius;

b) obtaining a monolithic X-ray-tube target cap having a shape of a solid disk and having a second radius which is larger than said first radius;

c) coaxially aligning said cylinder and said target cap;

d) after step c), inertially welding together said cylinder and said target cap;

e) after step d), machining said cylinder as required to define a hollow X-ray-tube target shaft having longitudinally-outermost first and second ends and having longitudinally-extending first and second portions, wherein said first portion extends longitudinally from proximate said first end toward said second portion, wherein said second portion extends longitudinally from proximate said second end toward said first portion, wherein said first and second portions have inner and outer radii, wherein said inner radius of said first portion is smaller than said inner radius of said second portion, and wherein said outer radius of said first portion is smaller than said outer radius of said second portion; and f) after step d), machining a through hole in said target cap such that said through hole is generally coaxially aligned with said longitudinal axis and such that the radius of said through hole is no larger than said inner radius of said first portion.

14. The method of claim 13, wherein step e) includes machining said cylinder such that said inner and outer radii of said first and second portions are generally constant, such that said inner radius of said first portion is no larger than half said inner radius of said second portion, and such that said outer radius of said first portion is no larger than half said outer radius of said second portion.

15. The method of claim 14, wherein step e) includes machining said cylinder such that said target shaft also has a generally radially extending shoulder portion, wherein said shoulder portion has a radially-innermost region extending to said first portion and has a radially-outermost region extending to said second portion.

* * * * *